United States Patent [19]

Guyer

[11] Patent Number: 4,469,329

[45] Date of Patent: Sep. 4, 1984

[54] SELF CONTAINED GAME

[76] Inventor: Reynolds W. Guyer, 33 E. Wentworth Ave., Suite 345, St. Paul, Minn. 55118

[21] Appl. No.: 383,013

[22] Filed: May 28, 1982

[51] Int. Cl.[3] ..... A63F 9/04
[52] U.S. Cl. ..... 273/146
[58] Field of Search ..... 273/145 A, 146

[56] References Cited

U.S. PATENT DOCUMENTS

| | | | |
|---|---|---|---|
| 882,945 | 3/1908 | Hurst | 273/146 |
| 1,584,316 | 5/1926 | Mayhew | 273/146 |
| 2,044,122 | 6/1936 | Michener | 273/146 X |
| 3,747,935 | 7/1973 | Engelbrecht | 273/138 R |

FOREIGN PATENT DOCUMENTS

| | | | |
|---|---|---|---|
| 1432719 | 2/1966 | France | 273/145 A |

*Primary Examiner*—William H. Grieb
*Attorney, Agent, or Firm*—Kinney & Lange

[57] ABSTRACT

The present invention relates to a game apparatus for playing a game of chance and entertainment. The game apparatus comprises a plurality of dice-like playing pieces and a container having a top and a bottom. The bottom of the container is formed in a cup shape for use in shaking and casting the playing pieces upon a playing surface. The top of the container has a plurality of recesses, each recess being formed to retain at least one of the playing pieces during play. The top of the container is selectively secured upon the bottom of the container to form a sealed chamber for storing the playing pieces when not playing the game.

10 Claims, 6 Drawing Figures

SELF CONTAINED GAME

BACKGROUND OF THE INVENTION

1. Field of the Invention

The present invention relates to game devices, and specifically to an apparatus for playing and storing a game of chance and entertainment.

2. Description of the Prior Art

Apparatus for playing games of amusement employing dice-like playing pieces are well known in the prior art. For example, U.S. Pat. No. 1,584,316 shows an educational game having a shaker box for casting dice-like playing pieces upon a playing surface. The shaker box in this patent has a cover and the faces of the playing pieces bear letters or are blank. In playing the game, players compete in spelling words in the least number of tosses of the pieces. Other patents featuring game devices include U.S. Pat. No. 3,747,935, which shows a receptacle for receiving dice when they are thrown during play of a game and U.S. Pat. No. 882,945, which teaches an amusement game wherein a special or "ruling" die is thrown initially at the start of each player's turn and directs the strategy of the player in that turn. In this latter patent, the ruling die has three sides labelled "High" and three sides labelled "Low". Depending on the roll of the ruling die, other dice are thrown by the player in an attempt to obtain a high or low score.

The present invention employs a plurality of dice-like playing pieces with at least one of the playing pieces acting as a ruling die and a two piece container for use in playing, scoring and storing the game. The present invention is manufactured from common materials and is a simple structure, providing a sturdy, inexpensive and entertaining game device.

SUMMARY OF THE INVENTION

The present invention is concerned with a game apparatus for playing and scoring a game of chance and entertainment. The apparatus also serves as a means for storing the pieces of the game when not in play. The apparatus consists of a plurality of dice-like playing pieces and a container having a top and bottom. The bottom of the container is formed in a cup shape for use in shaking and casting the playing pieces upon a playing surface. The top has a plurality of recesses, with each recess formed to retain at least one of the playing pieces during play. The top of the container is selectively secured upon the bottom of the container to form a sealed chamber for storing the playing pieces when the game is not in use.

In one embodiment of the game, each dice-like playing piece has a plurality of faces with each face bearing a different indicium thereon. The cup-shaped bottom of the container has a visible scoring chart which is used to determine a player's score, depending upon the indicia displayed on the playing pieces for that player's turn. In this embodiment, one of the dice-like playing pieces is called the "master-die". All the other dice-like playing pieces are identical. The indicia of the identical playing pieces are different from the indicia on the master die. The scoring chart has a plurality of columns, two of which are based on two alternative forms of strategy indicia borne on the master die along with other indicia. Half of the faces of the master die bear one form of the strategy indicia and the other half of the faces of the master die bear the other form of the strategy indicia.

The master die is used in conjunction with the scoring chart on the cup-shaped bottom of the container to direct a player's strategy in playing the game. The top of the container has three recesses: (1) a first recess formed to retain the master die, (2) a second recess formed to retain all of the identical playing pieces, and (3) a third recess formed to selectively retain one or more of the playing pieces prior to placing them in the first or second recess.

In another embodiment of the game device, all of the dice-like playing pieces of the game are identical and each dice-like playing piece has a plurality of faces with each face bearing a different indicium thereon, such as color. The cup-shaped bottom of the container has a visible scoring chart which is used to determine a player's score, depending upon the indicia displayed on the playing pieces for that player's turn. In this embodiment, the top of the container again has three recesses: (1) a first recess formed to retain one-half of the playing pieces, (2) a second recess formed to retain the remaining playing pieces, and (3) a third recess formed to selectively retain one or more of the playing pieces prior to placing them in the second recess. In playing the game, each identical playing piece is placed in the second recess to display one of its faces and match the indicium thereon with the displayed face and indicium of a corresponding identical playing piece in the first recess.

DETAILED DESCRIPTION OF THE PREFERRED EMBODIMENTS

Figure 1:
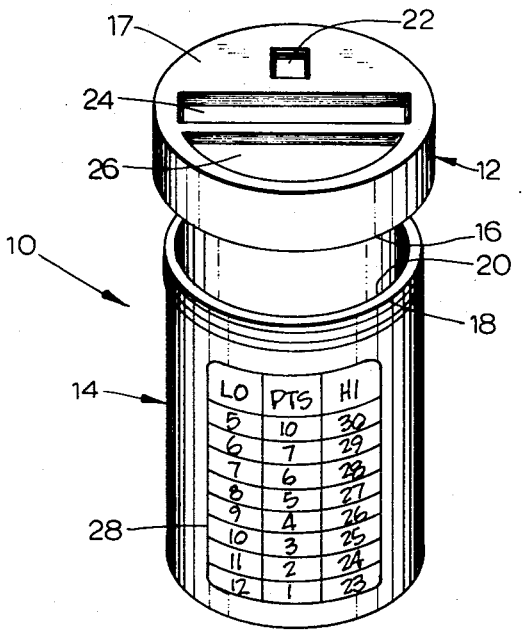
FIG. 1 is a perspective view of the game apparatus container of the present invention.

FIG. 1 shows a container 10 consisting of a top 12 and a bottom 14. The top 12 is selectively secured upon the bottom 14 to form a sealed chamber. Preferably, the top 12 is threaded on its inner surface along its bottom edge 16 so that it may be screwed upon a threaded portion 18 along a top edge 20 of the bottom 14.

A plurality of dice-like playing pieces are used in playing the game and may be stored in the chamber of the container 10 when the game is not being played. The bottom 14 is formed in a cup shape for use in shaking and casting the playing pieces upon a playing surface 25 during play. The top 12 has a surface 17 having a plurality of recesses with each recess formed to retain at least one of the playing pieces during play.

Any number of players can play games employing the game apparatus of the present invention. Players can compete individually or collectively by teams. For the sake of clarity, the discussion of how the game apparatus is used in playing certain games is in terms of players competing individually.

Figure 2A:
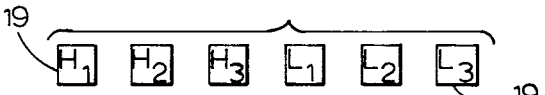
FIG. 2A shows the six faces and accompanying indicia of the master die.

In one embodiment of the game, one of the dice-like playing pieces is called a "master die". The master die has a plurality of faces with each face bearing a different indicium. FIG. 2A shows the faces and indicia thereon of a master die 19 having six faces. As shown, half of the faces of the master 19 die bear strategy indicia comprising the letter "H" which signifies "High". The other half of the faces of the master die 19 bear strategy indicia comprising the letter "L" which signifies "Low". The faces of the master die 19 also carry other indicia, which are scoring multipliers, such as the numbers 1, 2 or 3. As shown in FIG. 2A, the combination of letter and numeral indicia give each face of the master die 19 a different combination of indicium: (1) H/1, (2) H/2, (3) H/3, (4) L/1, (5) L/2, and (6) L/3. A player's strategy in playing the game is directed by the master die 19.

Figure 2B:
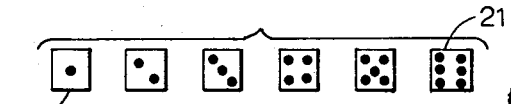
FIG. 2B shows the six faces and accompanying indicia of one of the identical playing pieces.

The rest of the dice-like playing pieces in this first embodiment of the game are identical. Each identical playing piece has a plurality of faces with each face bearing a different indicium. FIG. 2B shows the faces and indicia thereon of a dice-like playing piece 21 having six faces. Preferably, the game has five of these identical playing pieces 21. In FIG. 2B, it can be seen that the five identical playing pieces 21 have faces, bearing a different indicium on each face with the indicia numbering one through six, just like that of the common type of die used in a number of games. Of course, a comparison of the faces of the master die 19 in FIG. 2A with the faces of the identical playing pieces 21 of FIG. 2B shows that the indicia on the two types of playing pieces are quite different in nature.

The three recesses in the top 12 of the container 10 have unique shapes. The first recess, or master square 22, is formed to retain the master die 19 so that the indicium on one face of the master die 19 is displayed. The second recess, or rack 24, is formed to retain all of the identical playing pieces 21 so that the indicium on one face of each identical playing piece 21 retained therein is displayed. The third recess, or bull pen 26, is formed to selectively retain (during play) one or more of the playing pieces (including the master die 19) prior to placing the pieces in the master square 22 or rack 24.

The cup-shaped bottom 14 has a visible scoring chart 28 which is used to determine a player's score for a turn of the game. In FIG. 1, the scoring chart 28 on the bottom 14 is shown for the embodiment of the game employing a master die 19. The chart 28 has three columns: (1) a "LO" column—for use with the "L" faces of the master die 19; (2) a "HI" column—for use with the "H" faces of the master die 19; and (3) a "PTS" column—indicating the points a player achieves in a turn, depending on the combination of the displayed faces of the master die 19 and other playing pieces 21. Other forms of strategy indicia on the master die 19 are also possible. For example, color can be used rather than the designations "H" and "L". Of course, the columns of the scoring chart 28 bear suitable headings so that it is clear which column is used with each strategy indicium of the master die 19.

In this first embodiment of the game, the master die 19 is very important. The master die 19 controls a player's strategy in each turn by indicating two things: (1) the master die 19 shows whether the player will score points from the LO column or the HI column of the scoring chart 28 ("L" for LO, "H" for HI), and (2) the master die 19 shows the multiplier for the number of points scored by the player in the turn.

The object of the game is for a player to score more points than the opposition. Points are scored by trying to attain a perfect high score (30) or a perfect low score (5) during each player's turn of the game. The game is played by each player taking alternative turns until one of the players reaches a predetermined ceiling score such as fifty points or one hundred points, or until each player has taken a predetermined number of turns such as five or ten turns.

In each turn of the game, a player may take up to five casts of the playing pieces. To begin a turn, the player places the playing pieces (including the master die 19) in the cup-shaped bottom 14, shakes them and casts them upon the playing surface 25. After each cast, the player must place at least one of the identical playing pieces 21 in the rack 24. Once an identical playing piece 21 is placed in the rack 24, it may not be removed during that player's turn. Each identical playing piece 21 is placed in the rack 24 to display the face and indicium which were displaying upon casting the piece 21 on the playing surface 25. The master die 19 may be placed in the master square 22 after any one of the five casts of the playing pieces. The master die 19 is placed in the master square 22 to display the face and indicium which were displayed upon casting the master die 19 on the playing surface 25 and once the master die 19 has been placed in the master square 22, it may not be removed during that player's turn.

Playing pieces (including the master die 19) may be put on "hold" by placing them after a cast in the bull pen 26. If a player determines that it would be advantageous to retain certain playing pieces pending the outcome of the next cast of the remaining playing pieces, the player may place some of the pieces in the bull pen 26. After a cast, a player may keep (and not cast) one or more of the identical playing pieces 21 by putting that playing piece (or pieces) 21 in the bull pen 26. The player may also place the master die 19 in the bull pen 26. In following casts, the player may then use the identical playing pieces 21 from the bull pen 26 to add to the rack 24. In the case of the master die 19, the player may take the master die 19 from the bull pen 26 and place it in the master square 22. Alternatively, the player may take the identical playing pieces 21 or master die 19 from the bull pen 26 and cast them again, as long as there is at least one cast left in the player's turn. By the end of the turn (five casts), the player must have placed the master die 19 in the master square 22 and all five of the identical playing pieces 21 in the rack 24.

Figure 3:
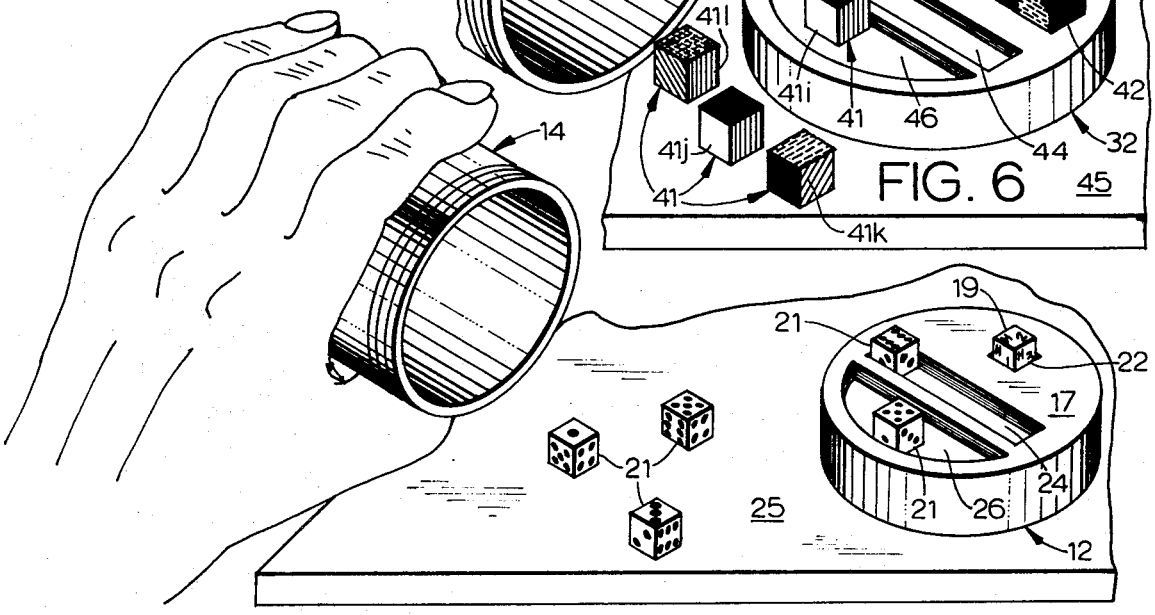
FIG. 3 is a perspective view of a player using one form of the game apparatus of the present invention.

After all the playing pieces have been placed in the master square 22 and rack 24 of the top 12, points are scored for the player's turn as determined by the total number displayed on the identical playing pieces 21, the scoring chart 28 and the indicium displayed on the master die 19. FIG. 3 is illustrative of a player in mid-turn who has already taken at least one cast of the playing pieces. After that first cast, the player chose to (1) place the master die 19 in the master square 22, (2) place one of the identical playing pieces 21 (displaying a "6") in the rack 24, (3) place one of the identical playing pieces (displaying a "5") in the bull pen 26 for possible future placement in the rack 24, and (4) recast the three remaining identical playing pieces 21.

In this turn, the master die 19 in the master square 22 shows the face bearing "H/2". Because the master die 19 displays the letter "H", the player seeks to attain a high score with the identical playing pieces 21 in order to obtain more points on scoring chart 28. In accord with this goal, the player placed the identical playing piece 21 bearing a "6" in the rack 24 and preserved the identical playing piece bearing a "5" for possible future use by putting it in the bull pen 26. The "6" is, of course, the maximum number attainable on a single identical playing piece 21 and thus, along with the "5", is quite useful in attaining a high score for a turn. In FIG. 3, the player has just made the second cast of the three remaining identical playing pieces 21. One of the pieces shows a "1", another shows a "3", and the third shows a "5". At this point in the turn, the player has several alternatives: (1) any of the three identical playing pieces 21 cast or the identical playing piece 21 in the bull pen 26 may be placed in the rack 24, (2) any of the three identical playing pieces 21 on the playing surface 25 or the identical playing piece 21 in the bull pen 26 may be re-cast, and (3) any of the three identical playing pieces 21 on the playing surface 25 may be placed in the bull pen 26 for future use. In choosing one of these alternatives, the player must be mindful of the rule that at least one of the identical playing pieces 21 must be placed in the rack 24 after each cast. Each player continues play in this manner until the master die 19 is in the master square 22 and all five of the identical playing pieces 21 are in the rack 24.

To score a player's turn, points are determined by the total number displayed on the identical playing pieces in the rack 24, the scoring chart 28 and the indicium displayed on the master die 19. The numbers displayed on the identical playing pieces 21 in the rack 24 are totaled and the total is found in the corresponding column of the scoring chart 28, depending on whether the master die 19 shows an "L" or an "H". The player's points (middle column) are determined by reading the scoring chart 28 horizontally from the applicable outer column. To determine a player's final score for a turn, the points for the turn are multiplied by the multiplier displayed on the master die 19.

Perhaps the most effective way to illustrate this scoring scheme is by example. If at the end of a turn the faces of the identical playing pieces 21 in the rack 24 display indicia adding up to the number ten (10) and the master die 19 reads "L/3", the player then consults the scoring chart 28 on the bottom 14 of the container 10 to determine the player's score for the turn. In this case, the scoring chart 28 would be read down the "LO" (for "L" or low) column to the number ten (10). The chart is then read horizontally to the middle points column ("PTS") where it can be seen that the player receives three points for the "10 LO" turn. These points are then multiplied by the multiplier displayed on the master die 19. Thus, the player in this turn would receive three points times the multiplier (3), for a total score of nine points.

The score for each player's turn is determined in a similar fashion, depending a great deal on the indicium displayed on the master die 19. The key, of course, is whether the master die 19 shows an "L" or an "H", which ultimately determines which column is used on entering the score chart 28. There is one wrinkle in the scoring process, as an examination of the scoring chart 28 would imply. For some identical playing piece number totals and master die indicia combinations, the player will receive no points. To score points in a "High" turn, a player's number total must be greater than twenty-two, and to score points in a "Low" turn, a player's number total must be less than thirteen. For example, if the identical playing pieces 21 had totaled the number ten as above, but the master die displayed an "H", then the scoring would be as follows: since the number ten total is less than 23 on the "H" column, the player receives no points for that turn. Similarly, if a player is attempting to attain a low number total and fails to get a number total less than thirteen, that player would receive no points for that turn.

Different scoring schemes for the game are also possible. One variation is to play and score exactly as described above with one exception. If a player casts (1) and "H/3" with the master die 19 and five sixes with the identical playing pieces 21, or (2) an "L/3" with the master die 19 and five ones with the identical playing pieces 21, that player would receive 50 points rather than the usual 30 as a reward for a perfect score in that turn. In another variation on the above scoring scheme, a player has the option, until the master die 19 is placed in the master square 24 during a turn, to remove any or all of the identical playing pieces 21 from the rack 24 and replace them with other identical playing pieces 21 (from the bull pen 26 or from those identical playing pieces 21 most recently cast) as long as the player adds at least one additional identical playing piece 21 to the rack 24 every time he makes a cast. In this variation, however, once the master die 19 is placed in the master square 22, no identical playing pieces 21 may be removed from the rack 24 during that turn.

Figure 4:
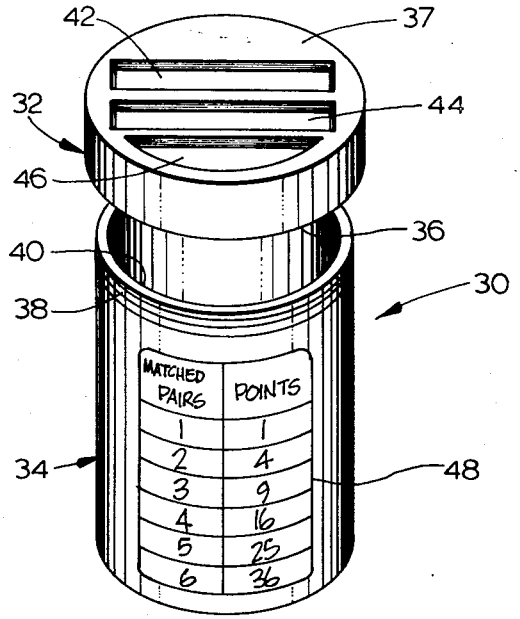
FIG. 4 is a perspective view of another embodiment of the game apparatus container.
Figure 5:
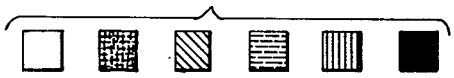
FIG. 5 shows the six faces of the identical playing pieces in the second embodiment of the invention wherein color is used as the indicia on the faces of the dice-like playing pieces.
Figure 6:
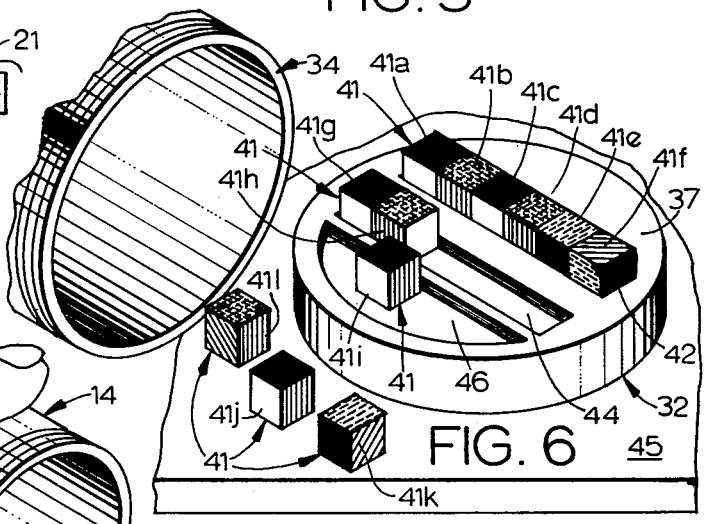
FIG. 6 is a perspective view of a player using another form of the game apparatus of the present invention.

Another embodiment of the game apparatus of the present invention is shown in FIGS. 4–6. Where applicable, the reference characters used in describing this embodiment are twenty higher than those used in the description of the first embodiment of the game apparatus. A container 30 has a top 32 and a bottom 34. The top 32 is selectively secured upon the bottom 34 to form a sealed chamber. The top 32 is threaded along its bottom edge 36 so that it may be screwed upon a threaded portion 38 along a top edge 40 of the bottom 34.

A plurality of dice-like playing pieces are used in playing the game of the second embodiment and may be stored in the chamber of the container 30 when the game is not being played. The bottom 34 is formed in a cup shape for use in shaking and casting the playing pieces upon a playing surface 45 during play. The top 32 has a surface 37 having a plurality of uniquely shaped recesses. The first recess, or master rack 42, is formed to retain one-half of the playing pieces. The second recess, or matching rack 44, is also formed to retain one-half of the playing pieces. The third recess, or bull pen 46, is formed to selectively retain during play, one or more of the playing pieces prior to placing the pieces in the matching rack 44.

In this embodiment of the game, all of the dice-like playing pieces are identical. Each dice-like playing piece has a plurality of faces with each face bearing a different inidicum thereon. The various indicia may take any form, such as letters, dots (as in FIG. 2B), or color. FIG. 5 shows the faces and indicia thereon of a dice-like playing piece 41 having six faces with each face bearing a different color. Preferably, the game has twelve of these identical playing pieces 41. The lining or shading on the faces of the playing piece 41 shown in FIG. 5 indicates the differing colors of the faces on each playing piece 41.

The cup-shaped bottom 34 has a visible scoring chart 48 which is used to determined a player's score for each turn of the game. The chart 48, shown in FIG. 4, has two columns: (1) a column with six characters entitled "MATCHED PAIRS", and (2) a column with six characters entitled "POINTS". This embodiment of the game may be played by any number of players. The object of the game is for a player to score more points than the opposition. Points are scored by trying to attain matched pairs of the playing pieces 41 in the master rack 42 and matching rack 44. The game is played by players taking alternative turns until one of the players reaches a predetermined ceiling score such as fifty or one hundred points or until each player has taken a predetermined number of turns such as five or ten turns.

To begin a turn, a player places all twelve of the playing pieces 41 in the cup-shaped bottom 34, shakes them and casts them upon the playing surface 45. The player selects any six of the playing pieces 41 cast and places them in the master rack 42 of the top 32. The player then has up to six casts of the remaining playing pieces 41 to match the indicium of each of the playing pieces 41 displayed in the master rack 42. After each cast, the player must place at least one of the remaining playing pieces 41 in the matching rack 44 to form a matched pair of playing pieces 41 with one of the playing pieces 41 of the pair being in the master rack 42 and the other playing piece 41 of the pair being in the matching rack 44. Once a playing piece 41 is placed in the matching rack 44, it may not be removed during that player's turn, and once a playing piece 41 in the master rack 42 has been used to form a matched pair, that playing piece 41 cannot be used again in that player's turn to form another match.

Each playing piece 41 is placed in the matching rack 44 to display the face and indicium which were displayed upon casting the piece 41 on the playing surface 45. Any of the remaining playing pieces 41 may be put on "hold" by placing them after a cast in the bull pen 46. If a player determines that it would be advantageous to retain certain playing pieces 41 pending the outcome of the next cast of the remaining playing pieces 41, the player may place some of the playing pieces 41 in the bull pen 46. This is an important feature of the game because if a player is unable to place a matching playing piece 41 in the matching rack 44 after a cast, then the turn is over for that player. Thus, if a player has a playing piece 41 in the bull pen 46 (that could have been placed in the matching rack 44 in an earlier turn to match one of the playing pieces 41 in the master rack 42) and he casts no matches, the playing piece 41 in the bull pen 46 may be placed in the matching rack 44 to allow the player at least one more cast. The object of the game is, of course, to obtain as many matched pairs of the playing pieces 41 in the master rack 42 and matching rack 44 as is possible in a turn. A turn consists of the initial cast of all twelve playing pieces 41 and up to six matching casts.

If a player has attained six matched pairs in a turn or, after a cast, is unable to place a playing piece 41 in the matching rack 44, then that player's turn is over and his points are determined for that turn. Points are scored for the player's turn as determined by the number of matched pairs the player has attained. The number of matched pairs is added up and the total is found on the corresponding column "MATCHED PAIRS" of the scoring chart 48. The player's points are determined by reading the scoring chart 48 horizontally from the number of matched pairs in the "POINTS" column. Depending on the number of matched pairs a player has attained, the scoring chart 48 provides the player's final score for that turn.

FIG. 6 is illustrative of a player in mid-turn who has already taken at least three casts of the playing pieces 41. The first cast was necessary to place half of the playing pieces 41 in the master rack 42, as indicated by playing pieces 41*a*, 41*b*, 41*c*, 41*d*, 41*e*, and 41*f*. Once these six playing pieces 41*a–f* have been placed in the master rack 42, the player is ready to begin attempting to match the remaining playing pieces 41 upon further casts.

The example of FIG. 6 shows a turn of a player wherein at least two casts has been made by the player after filling the master rack 42 with playing pieces 41. Three matched pairs have thus far been attained by the player shown in FIG. 6. Two of the matched pairs are comprised of playing pieces 41*g* and 41*h* which were placed in the matching rack 44 to correspond with matching playing pieces 41*a* and 41*b*, respectively. Playing piece 41*i* (which forms a matched pair with playing piece 41*c* in the master rack 42) has been placed in the bull pen 46. The three remaining playing pieces 41*j*, 41*k*, and 41*l* have been recast on the playing surface 39 as shown in FIG. 6. Playing piece 41*i* was placed in the bull pen 46 in case a recast of the remaining playing pieces 41*j*, 41*k*, and 41*l* failed to produce a match with any of the remaining playing pieces in the master rack 42.

In FIG. 6, the player has just made a further cast of the three remaining playing pieces 41*j*, 41*k*, and 41*l*. Playing piece 41*l* matches playing pieces 41*d* in the master rack 42 and thus can be placed in the matching rack 44 to form a matched pair. No matches are available between the playing pieces 41*j* and 41*k* and the remaining playing pieces 41*e* and 41*f* in the matching rack 42. At this point in the turn, the player has several alternatives: (1) playing piece 41*l* may be placed in the matching rack 44 to match with playing piece 41*d*; (2) playing piece 41*l* may be placed in the bull pen 46 for future use; (3) playing piece 41*i* in the bull pen 46 may be placed in the matching rack 44 to form a match with playing piece 41*c*; and (4) up to three of the four playing pieces 41*i*, 41*j*, 41*k*, and 41*l* may be recast by the player. In choosing one of these alternatives, the player must be mindful of the rule that at least one of the playing pieces 41 must be placed in the matching rack 44 after each cast to form a matched pair with one of the playing pieces 41 in the master rack 42. Thus, either playing piece 41*i* or playing piece 41*l* must be placed in the matching rack 44 for the player to continue play. Each player continues play in this manner until six matched pairs have been attained in a turn or, after a cast, the player is unable to place any of the remaining playing pieces 41 in the matching rack 44 to form a pair with one of the playing pieces 41 already in the master rack 42.

An example of the scoring scheme for this game is as follows. If, at the end of a turn, the player has attained five matched pairs of playing pieces 41, the player then consults the scoring chart 48 on the bottom 34 of the container 30 to determine the player's score for that turn. In this case, the scoring chart 48 would be read down the "MATCHED PAIRS" column to the number "5" which represents the numbers of matched pairs attained in the turn. The chart is then read horizontally to the "POINTS" column where it can be seen that the player receives "25" points for attaining five matched pairs during a turn. The score of each player's turn of the game is determined in a similar fashion. Of course, different scoring schemes for this game are also possible. One variation is to play and score exactly as was described above with the exception that if a player attains six matched pairs in a turn (a perfect score), the player is awarded a bonus of five points.

CONCLUSION

The present invention provides a game apparatus used for playing games of chance and entertainment. The game apparatus has a plurality of playing pieces and a container having a detachable top and a cup-shaped bottom. In playing a game using this apparatus, the playing pieces are shaken and cast from the bottom. During play, the playing pieces are selectively placed in a plurality of recesses formed in the top of the container and one of the recesses is used for selectively retaining one or more of the playing pieces prior to placing them in other recesses. Upon completion of a player's turn, the player's score is determined by the combination of playing pieces and a visible scoring chart on the bottom of the container.

Although the present invention has been described with reference to preferred embodiments, workers skilled in the art will recognize that changes may be made in form and detail without departing from the spirit and scope of the invention.

What is claimed is:

1. A game apparatus comprising:

a plurality of dice-like playing pieces, each dice-like playing piece having a plurality of faces, and each face bearing a different indicium thereon;

a container having a first portion and a tubular second portion, the tubular second portion being formed in a cup shape for use in shaking and casting the playing pieces upon a playing surface, and the first portion having a least one recess therein formed to retain at least one of the playing pieces during play and being selectively securable upon the tubular second portion to form a closed chamber for storing the playing pieces; and a visible scoring chart which is used to determine a player's score for a turn, depending upon the indicia displayed on the playing pieces, and the scoring chart being on an outer surface of the tubular second portion of the container.

2. A game apparatus comprising:

a plurality of dice-like playing pieces, each dice-like playing piece having a plurality of faces, and each face bearing a different indicium thereon;

a container having a first portion and a second portion, the second portion being formed in a cup shape for use in shaking and casting the playing pieces upon a playing surface, the first portion having a plurality of recesses with each recess formed to retain at least one of the playing pieces during play, and the first portion being selectively securable upon the second portion to form a closed chamber for storing the playing pieces; and a visible scoring chart which is used to determine a player's score for a turn, depending upon the indicia displayed on the playing pieces.

3. A game apparatus comprising:

a plurality of dice-like playing pieces with one of the dice-like playing being called the master die, the master die having a plurality of faces, each face bearing a different indicium thereon, the other dice-like playing pieces being identical, each identical playing piece having a plurality of faces, each face bearing a different indicium thereon, and the identical playing piece indicia being different from the master die indicia;

a container having a first portion and a second portion, the second portion being formed in a cup shape for use in shaking and casting the playing pieces upon a playing surface, and the first portion having at least one recess therein formed to retain at least one of the playing pieces during play and being selectively securable upon the second portion to form a closed chamber for storing the playing pieces; and a visible scoring chart which is used to determine a player's score for a turn, depending upon the indicia displayed on the playing pieces.

4. The apparatus of claim 3 wherein the first portion of the container has a plurality of recesses, and each recess is formed to retain at least one of the playing pieces during play.

5. The apparatus of claim 3 wherein the scoring chart has a plurlity of columns, two of the columns of the scoring chart being based upon two alternative forms of strategy indicia borne on the master die along with other indicia, one form of the strategy indicia being on certain faces of the master die, the other form of the strategy indicia being on other faces of the master die, and the master die and its respective indicia being used in conjunction with the scoring chart to direct a player's strategy in playing the game.

6. The apparatus to claim 5 wherein one form of the strategy indicia on the master die indicates "High" thus directing a player's strategy during a turn in a certain way and the other form of strategy indicia on the master die indicates "Low" thus directing a player's strategy during a turn in another way.

7. The apparatus of claim 3 wherein the first portion of the container has three recesses, a first recess formed to retain the master die, a second recess formed to retain all of the identical playing pieces, and a third recess formed to selectively retain one or more of the playing pieces prior to placing them in the first or second recess.

8. A game apparatus comprising;

a plurality of identical dice-like playing pieces, each dice-like playing piece having a plurality of faces, and each face bearing a different indicium thereon;

a container having a first portion and a second portion, the second portion being formed in a cup shape for use in shaking and casting the playing pieces upon a playing surface, the first portion having three recesses, a first recess formed to retain one-half of the playing pieces, a second recess formed to retain the remaining playing pieces, and a third recess formed to selectively retain one or more of the remaining playing pieces prior to placing them in the second recess, and the first portion being selectively securable upon the second portion to form a closed chamber for storing the playing pieces; and a visible scoring chart which is used to determine a player's score for a turn, depending upon the indicia displayed on the playing pieces.

9. The apparatus of claim 8 wherein:

the first recess and second recess in the first portion of the container are formed so that the indicium is displayed on one face of each identical playing piece retained therein, and each identical playing piece is placed in the second recess to display one of its faces and match the indicium thereon with the displayed face and indicium of the corresponding identical playing piece in the first recess.

10. A game apparatus comprising:

a plurality of dice-like playing pieces, each dice-like playing piece having a plurality of faces, and each face bearing a different indicium thereon;

a container having a first portion being formed in a cup shaped for use in shaking and casting the playing pieces upon a playing surface, said container having a second portion separate from said cup shape portion and having a plurality of recesses with each recess formed to retain at least one of the playing pieces during play; and a visible scoring chart which is used to determine a player's score for a turn, depending upon the indicia displayed on the playing pieces.

* * * * *